United States Patent [19]

Wayland

[11] 4,370,530

[45] Jan. 25, 1983

[54] ELECTROLYTIC CELL ELECTRICAL SHUNTING SWITCH ASSEMBLY

[75] Inventor: Paul O. Wayland, Montour Falls, N.Y.

[73] Assignee: Westinghouse Electric Corp., Pittsburgh, Pa.

[21] Appl. No.: 154,153

[22] Filed: May 28, 1980

[51] Int. Cl.[3] ..... H01H 33/66

[52] U.S. Cl. ..... 200/144 B; 204/98; 204/228

[58] Field of Search ..... 200/144 B, 145; 204/98, 204/228

[56] References Cited

U.S. PATENT DOCUMENTS 4,227,987 10/1980 Kircher et al. ..... 204/228

4,251,334 2/1981 Kircher ..... 204/98

4,302,642 11/1981 Hruda et al. ..... 200/144 B

*Primary Examiner*—Robert S. Macon

*Attorney, Agent, or Firm*—W. G. Sutcliff

[57] ABSTRACT

An electrical shunting switch assembly is adapted to be connected across the terminals of an electrolytic cell. The switch assembly acts as a parallel current carrying shunt path around the cell when the switches of the assembly are in the closed, current carrying position. The switch assembly comprises a plurality of electrically parallel branch conductor paths which each include at least one vacuum switch and a series-connected resistor. The switch assembly includes means for asynchronously, individually operating the vacuum switches to open the switches periodically and divert an increased portion of the current from the switch assembly back through the electrolytic cell when the voltage across the switch assembly exceeds the cell electrolyzing potential.

10 Claims, 4 Drawing Figures

ELECTROLYTIC CELL ELECTRICAL SHUNTING SWITCH ASSEMBLY

BACKGROUND OF THE INVENTION

The present invention relates to electrical shunting switch assemblies designed for use with electrolytic cells. The switch assembly acts as a parallel current carrying shunt path around the electrolytic cell when the switches of the assembly are in the closed, current carrying position. The electrolytic cell may then be serviced while other cells in a multi-cell system remain in operation. The switch assembly is thereafter actuated to open the switches and divert current back through the cell when the cell is to be connected back in the system. More particularly this electrical shunting switch assembly utilizes a plurality of vacuum switches which are electrically connected in parallel path relationship with a series connected predetermined resistance value in each parallel path, and including means for asynchronously operating the vacuum switches. The shunting switch assembly is adapted to be electrically connected in parallel across the terminals of the electrolytic cell. The vacuum switches of the present invention are more particularly adapted to be utilized with a diaphragm or membrane type electrolytic cell.

The term electrolytic cell applies to a variety of electrochemical devices ranging from electrolytic metal refining devices to more widely used chlor-alkali cells. These latter chlor-alkali electrolytic cells rely upon the passage of a DC electric current through an alkali metal halide solution to separate useful chemical constituents. The most widely used such chlor-alkali cells are mercury cells in which mercury is used as one of the electrodes of the device, and alkali metal hydroxide and halogen gas are produced. The use of vacuum electrical shunting switches with such mercury type cells is described in U.S. Pat. No. 4,075,448. The use of such vacuum type cell bypass or shunting switches with such mercury cells results in improved efficiency of operation of the cells, as well as reliable and simplified maintenance and operation of the cells. The layout of a mercury cell plant is such that it has been the practice to connect in place as a permanent connection, one or more of the vacuum type switches described in the aforementioned patent.

In a diaphragm type chlor-alkali electrolytic cell, one or more diaphragms which are permeable to the flow of electrolyte solution are utilized to separate the halogen gas and the alkali metal hydroxide. In a membrane type electrolytic cell one or more membranes or ion-exchange barriers or membranes, are utilized to effect separation of the alkali metal hydroxide and halogen gas. Such diaphragm and membrane type cells are generally more compact in their physical layout and require less frequent periodic maintenance. It has thus been the practice to utilize portable electrical cell shunting assemblies with such diaphragm type cells with conventional knife-edge or air-exposed breaker type electrical switches. In general, diaphragm and membrane type cells carry higher operating currents, and thus impose more severe current interrupting capability upon the electrical bypass or shunting switch assemblies.

The electrical shunting switch utilized with a diaphragm or membrane cell must be capable of carrying and interrupting the very high DC currents of the system, which currents range up to several hundred thousand amperes. The shunting switch must interrupt current in the shunt path when the cell is to be placed back in series operation with the other cells of a plant. A significant amount of energy must be dissipated in the vacuum switch during interruption of the high bypass current.

An earlier vacuum switch assembly which was capable of portable connection to such diaphragm or membrane type cells is described in U.S. Pat. No. 4,302,642 filed Aug. 24, 1977 entitled "Vacuum Switch Assembly". In this earlier shunting switch assembly, a plurality of vacuum switches are connected in parallel path relationship with individual parallel electrical bus conductors extending from each switch contact in electrical parallel isolated relationship from each side of the switch to the respective cell terminals. The resistance values of these electrical bus conductors and the physical relationships were such as to minimize self-inductance and mutual inductance effects so that the energy which must be dissipated in the last-to-open vacuum switch interrupter is minimized. In this earlier switch assembly a common operating drive mechanism was utilized to approximately simultaneously open the vacuum switch contacts during current interruption. It is known that it is physically impossible to exactly simultaneously open such a plurality of switches. The last-to-open switch contacts will thus carry the total current in the parallel path shunt assembly. It was the purpose of this earlier switch assembly to reduce the energy which must be dissipated in the last open switch.

It is a general objective in designing vacuum switch electrical shunting assemblies to minimize the arc current which the switch contacts are called upon to interrupt and dissipate. The vacuum switches are designed for long lived, reliable switch operation at a predetermined design level or rating.

SUMMARY OF THE INVENTION

An electrical shunting switch assembly is described which is adapted to be electrically connected in parallel across the terminals of the electrolytic cell. The assembly comprises a plurality of vacuum switches which are electrically connected in parallel path relationship with a series connected predetermined resistance value in each parallel path, and includes means for asynchronously operating the vacuum switches. The vacuum switches are operated or opened from their closed contact, current carrying, cell shunting function to divert current from the switch assembly back through the cell when the voltage across the switch assembly exceeds the cell electrolyzing potential. In this way the arc current which an individual vacuum switch, and in particular the last to open switch, must dissipate upon switch opening is limited to a predetermined design value.

The term asynchronous switch operation has particular reference in this invention to switch opening, and asynchronous means that the individual vacuum switches are independently operated in a predetermined time sequence. This is in contrast to prior art vacuum shunting switch assemblies in which the vacuum switches were generally operated simultaneously with the realization that there was always one last to open switch. In one embodiment of the invention each switch in individual parallel branches is independently asynchronously operated. In other embodiments with plural switches paralleled in sub-branches, the switches of the sub-branch may be simultaneously operated or opened together, but are independently or asynchronously opened with respect to the switches of the other main parallel branches.

DESCRIPTION OF THE PREFERRED EMBODIMENTS

Figure 1:
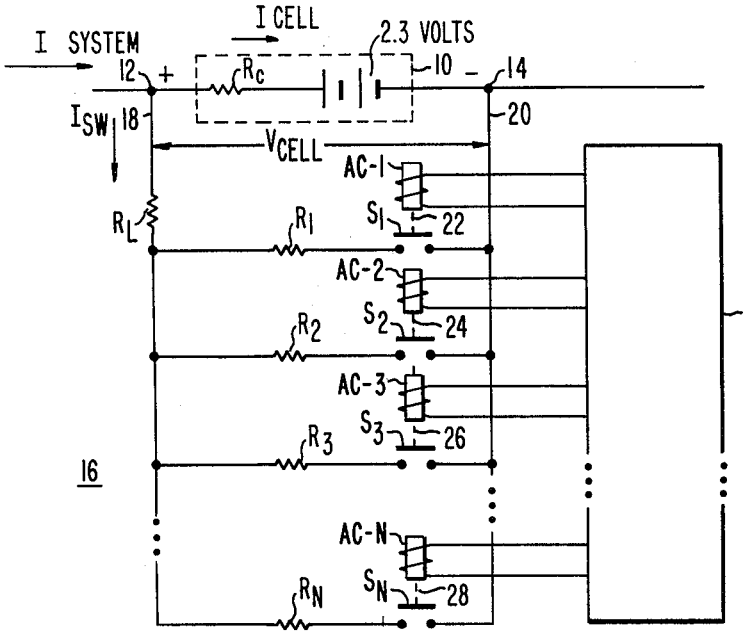
FIG. 1 is a schematic representation of the electrolytic cell electrical shunting switch assembly of the present invention connected across an electrolytic cell.

The present invention can be best understood by reference to the embodiments seen in the drawings. In FIG. 1 the electrolytic cell 10 is a diaphragm or membrane type electrolytic cell having an anode terminal 12 and a cathode terminal 14. The electrolytic cell 10 is one of a plurality of series connected cells which operate as a relatively constant current system from a DC power supply which can deliver currents of the order of 150,000 amperes. There may be 100 to 200 cells in series, and the operating potential drop across an individual cell will be about 3.8 volts. The shunting of a single cell in the series connected cell system has very little effect on the total system and the current will remain relatively constant. These cell terminals 12 and 14 are connected to the plant load line, which is by way of example a line which carries about 150,000 amperes load current for the system. The electrolytic cell 10 has an internal resistance value of $R_C$ and which is typically about 8 to 10 micro-ohms, and can also be represented by an electrolyzing potential of about 2.3 volts which appears across the anode and cathode terminals when the cell is not carrying current. An electrical shunting switch assembly 16 is connected in electrical parallel relationship across the anode and cathode terminals 12 and 14 respectively. The shunting switch assembly 16 comprises a plurality of vacuum switches S1, S2, S3, SN disposed in electrically parallel path relationship with corresponding series resistance values R1, R2, R3, RN in the individual parallel branch paths. The exact number of parallel paths and vacuum switches SN in the switch assembly is largely determined by the plant load current, with the higher the current in general the greater the number of paths and switches. Thus, for a plant with a load current of 150,000 amperes there may be 36 paths and switches. The resistance values of R1, R2, R3 and RN are determined so as to develop sufficient IR potential drop across the current carrying switch assembly so that compared to the electrolytic cell potential there will be diversion of an increased proportion of the current from the switch assembly back through the cell when the potential across the switch assembly exceeds the cell electrolyzing potential. The resistance value is typically provided by the bus conductor leads which are dimensioned to give the desired branch path resistance value. While such bus conductors are typically copper, a stainless steel bus conductor may be used to provide the desired resistance value. A physical resistor may also be used.

The plurality of separate parallel paths of switches and resistor values are connected to electrical bus leads 18 and 20, which are connectable respectively to the cell anode and cathode terminals 12 and 14. Each individual vacuum switch SN is controlled and operated by an air cylinder AC1, AC2, AC3, ACN. The air cylinders ACN are connected via respective link means 22, 24, 26, 28 which effectuate axial movement of the switch contacts for opening and closing the switch contacts. The air cylinders ACN are controlled from a master controller 30 which asynchronously actuates the air cylinders to operate the individual vacuum switches at predetermined timed intervals. Other types of vacuum switch actuators including electrical solenoids can be used. By way of example, for a cell with a current carrying load of 150,000 amperes 36 separate parallel branch paths and vacuum switches SN, are utilized. The shunt assembly bus connectors 18 and 20 typically have a resistance value represented by $R_L$ of about 3 micro-ohms. The resistance value RN in each parallel branch or path of the 36 switch assembly is about 252 micro-ohms. The master controller 30 effectuates operation of the individual air cylinders ACN and the respectively connected vacuum switch SN at about 30 millisecond time intervals. It can be appreciated that when all 36 vacuum switches SN are closed no current flows through the electrolytic cell 10 because the cell voltage is below the 2.3 volts electrolyzing potential the cell. The total current in the system flows through the switch assembly or shunting assembly 16 and the current in each vacuum switch resistor parallel path is approximately 4,167 amperes. As successive vacuum switches SN are opened in a periodic manner, it is appreciated that no current will flow or be diverted back through the cell until the cell voltage exceeds the 2.3 volt electrolyzing potential. It has been estimated that this will occur when 20 such vacuum switches are still closed each carrying about 7,590 amperes, and that as subsequent vacuum switches are opened, an increased portion of the current will be diverted back through the electrolytic cell. When the last-to-open switch is opened, the bulk of the current will be flowing through the cell and the last-to-open vacuum switch must dissipate a current of only about 13,567 amperes, which is easily within the design capability of the switch.

The current which was being carried in 36 branch paths is now carried by the 20 branch paths were the switches remain closed. This results in higher currents in these 20 branch paths and the effective resistance of the shunt is increased as a result of the reduction in the number of parallel branch paths still carrying current, so there is a higher IR drop across the shunt assembly. Eventually this IR drop across the shunt assembly will exceed the cell electrolyzing potential and current will begin to be directed back through the cell. With each successive switch opening, and further reduction in the number of branch paths carrying current, an increasing portion of the current is directed back through the cell.

The schematic illustration of FIG. 1 does not reflect the fact that there would be a transient countercurrent associated with the electrolytic cell when the system current is initially shunted to the switch assembly by closing vacuum switches. This transient current would be negated by using a high power diode in the line. There is no such transient countercurrent associated with opening the shunt switch assembly when current is diverted back through the cell.

The number of vacuum switches utilized in the shunting assembly and the resistance values for the series connected resistors can be widely varied within the general requirement that the current for the last-to-open switch should be reduced to a current level within the capability or design value of a single vacuum switch. The period between successive switch openings was given as about 30 milliseconds. This is easily accomplished by using an air cylinder or other electromechanical operating mechanisms. In general it is desirable to be able to effectuate diversion of the current from the shunting assembly back to the cell in as short a time as possible to optimize efficiency of the cell and electrical energy. It is generally impractical and not desirable to shorten the time between switch openings to less than about 10 milliseconds which approximates the inductive transfer time regime in which energy stored in the switch and line would be transferred back to the cell. In general, the longer time period between switch openings the less efficient use of the electrical energy of the plant. It is of course not essential that the time period between switch openings be of short duration or of equal duration, and can in fact be readily varied by varying the master control operating the air cylinders.

In the above example, individual air cylinders are connected to each individual vacuum switch to effectuate asynchronous operation of the switches. This asynchronous operation can be effectuated in a number of ways including the use of eccentric cam means associated with a common rotating shaft as generally described in U.S. Pat. No. 4,121,268, in which the eccentric cam means was used to determine the last opened switch of a series of parallel connected switches. It is possible to combine the use of air cylinders and cam means mounted on rotating shafts connected to a switch operating link in carrying out the present invention.

Figure 2:
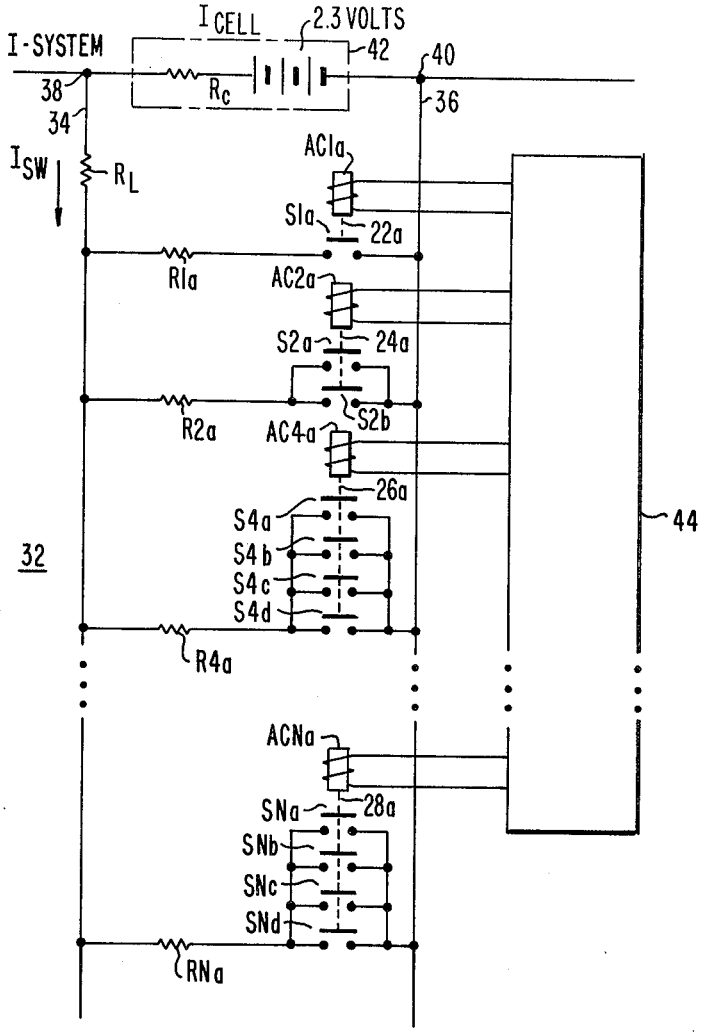
FIG. 2 is a schematic illustration of an alternative electrolytic cell electrical shunting switch assembly of the present invention again connected across the electrolytic cell.

In another embodiment of the invention illustrated in FIG. 2 the electrical shunting switch assembly 32 is seen connected via bus connectors 34 and 36 to the respective anode and cathode terminals 38 and 40 of the electrolytic cell 42. In this embodiment, the number of separate parallel path conductor branches of the shunting assembly has been reduced by paralleling two or more vacuum switches per parallel branch path for the branches other than the first branch, and reducing the resistance value RN proportionate to the number of contacts or switches per branch. In this way a first parallel path or branch between bus connectors 34 and 36 includes vacuum switch S1*a*, resistor R1*a*, and air cylinder AC1*a*. In a second parallel path across bus connectors 34 and 36, the resistance R2*a* is one half the resistance value of R1*a*, and a pair of vacuum switches S2*a* and S2*b* are paralleled in this second branch path. Air cylinders AC2*a* is connected respectively to simultaneously operate the vacuum switches S2*a* and S2*b*, but to operate them asynchronously relative to the other vacuum switches. An air cylinder control means 44 is connected to each individual air cylinder to permit successive separate operation of the vacuum switches. In a third parallel branch conductor path with resistance R4*a* are four electrically parallel connected vacuum switches S4*a*, S4*b*, S4*c*, S4*d*. Air cylinder AC4*a* is connected to each of these switches via linking means for substantially simultaneously operating these four switches. Air cylinder AC4*a* is likewise connected to master air cylinder control means 44 which operates the vacuum switches of the various parallel branch paths in an asynchronous timed manner. Additional parallel branch conductor paths include resistor RNa and four electrically parallel connected vacuum switches SNa, SNb, SNc, SNd. An air cylinder ACNa is provided connected to the control means 44 and to the switches SNa, SNb, SNc, and SNd via movable linking means 22*a*, 24*a*, 26*a*, 28*a*, for substantially simultaneously operating these four switches and asynchronously relative to the other vacuum switches in the other parallel branch paths.

It is possible with the switch assembly of FIG. 2 to provide the same functional current diversion capability as for the embodiment of FIG. 1. This is achieved by proper sequencing of the switch openings. This sequencing can be thought of as a binary system in which switch S1*a* is opened first. Thereafter, switch S1*a* is closed, and switches S2*a* and S2*b* are opened. Then switch S1*a* is opened again while leaving S2*a* and S2*b* opened. As can be appreciated this is the same as opening one switch at a time in the FIG. 1 embodiment. The next step would be to close S1*a*, S2*a* and S2*b*, and open S4*a*, S4*b*, S4*c* and S4*d*. This sequencing would then be following with the SN series of four switches SNa, SNb, SNC, SNd along with the S1*a*, S2*a*, and S2*b* switches.

Various other parallel branch conductor path arrangements can be used in practicing the invention, with the number of parallel branch conductor paths being varied to meet the current range requirements of the cell to which the switch assembly is to be connected. The number of vacuum switches which are paralleled in forming sub-branches within a branch path can also be varied. It is possible to operate each of the paralleled switches in a sub-branch in an individual asynchronous manner, rather than simultaneously as described for the FIG. 2 embodiment.

Figure 4:
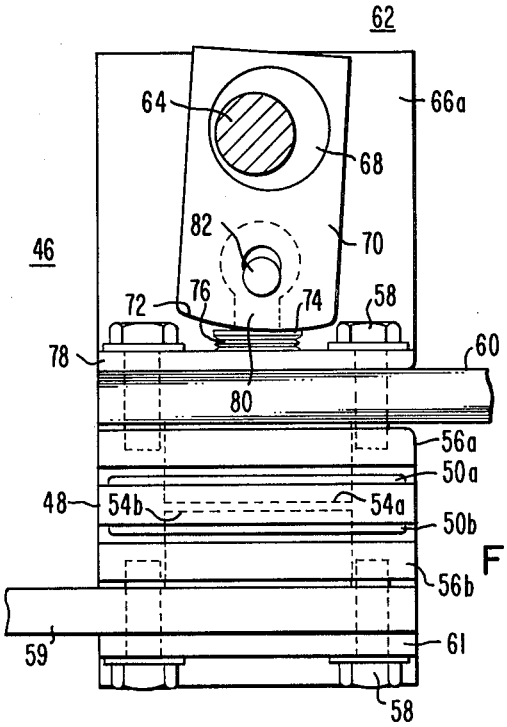
FIG. 4 is a side elevational view partly in section taken along the direction IV—IV of FIG. 3 to facilitate understanding of the switch assembly and method of operation.
Figure 3:
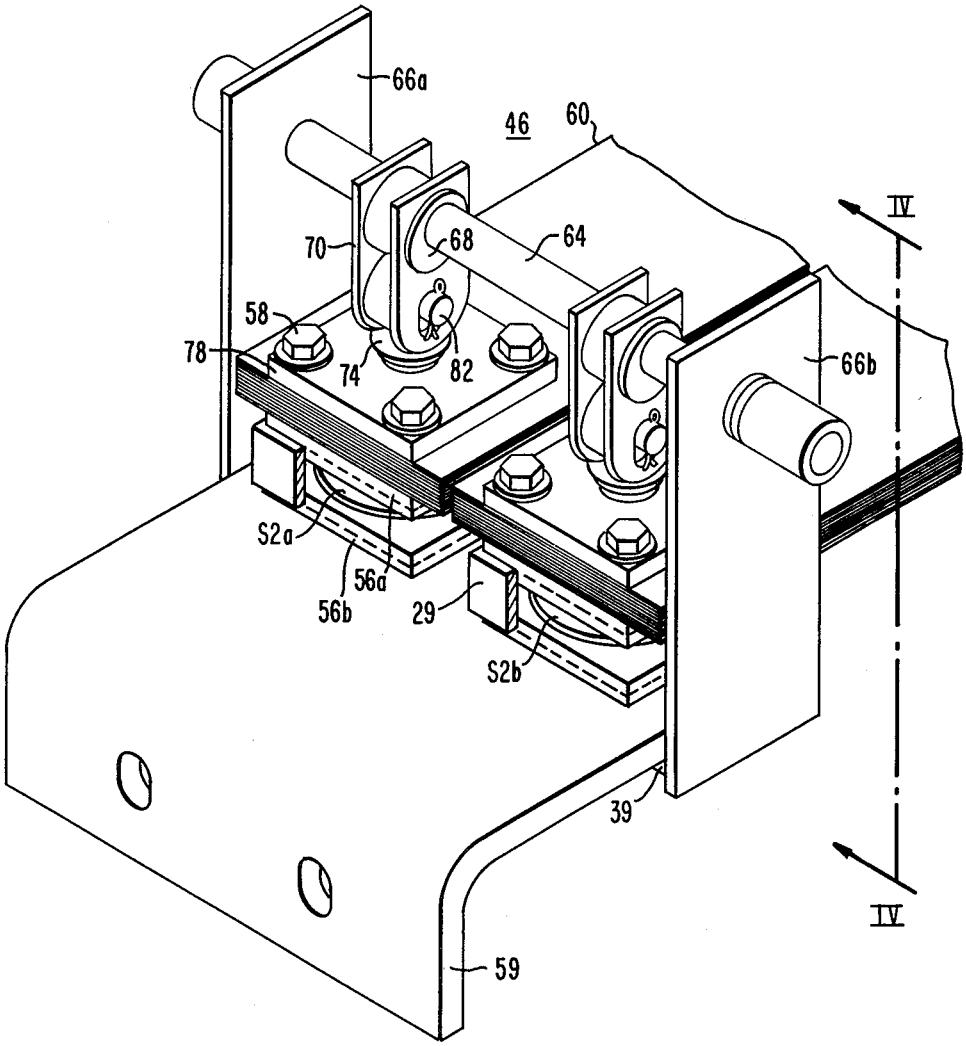
FIG. 3 is a perspective view of a portion of the shunting switch assembly of the present invention, and more particularly where two vacuum switch modules are connected to a common operating mechanism for approximately simultaneous operation.

The linking means 22, 24, 26, 28 represented in FIG. 1 between the respective air cylinders and vacuum switches may be simple reciprocable links which move the switch contacts the short axial distance of less than about 0.25 inch from the closed to open position. The linking means illustrated in FIGS. 3 and 4 is more complicated and includes a rotatable shaft which is operated from the respective air cylinder with means not shown for translating the air cylinder rod motion to circular motion of the shaft. The shaft 64 is used to operate more than one vacuum switch, as for switches 52*a*, 52*b*, via reciprocable link 70.

The vacuum switches and operating mechanism of the shunting assembly are perhaps best seen and understood by reference to FIGS. 3 and 4. In FIG. 3 and FIG. 4, a two vacuum switch and operating mechanism module 46 as would correspond to switches S21 and S22 of FIG. 2 are seen in perspective. The vacuum switch and operating mechanism seen here is the subject of U.S. Pat. No. 4,216,359 filed June 13, 1978 entitled "Low Voltage Vacuum Switch and Operating Mechanism". The low voltage vacuum switch S21 comprises an insulative ceramic body ring 48 which electrically isolates one end or contact of the switch from the other. The opposed end surfaces of the insulative body ring 48 are metalized by conventional process, and a pair of thin, flexible, annular members 50A and 50B are sealed to the metalized end surface. These annular members 50A and 50B are metal diaphragm type members having a plurality of annular corrugations to permit flexing of the switch contacts. The outer perimeter portion of the annular flexible members 50A and 50B is brazed to the metalized coating on the insulating body ring. The inner perimeter portion of the annular flexible members 50A and 50B is brazed to the respective cylindrical conductive support post 52A and 52B. The cylindrical conductive support post 52A and 52B pass through and are sealed to the flexible annular members 50A and 50B. The centrally disposed insulative body ring 48, the flexible annular members 50A, 50B and the cylindrical conductive support posts 52A, 52B comprise a hermetically sealed envelope for the vacuum switch. The contact surfaces 54A and 54B at the inwardly extending ends of the respective support posts 52A, 52B are formed of nonweldable contact material. Planar mounting plates 56A, 56B have support post receiving apertures therethrough and are brazed to the extending ends of the support posts outside of the vacuum envelope. The support posts protrude a small distance through the planar mounting plates to make contact with the respective bus connector leads. The planar mounting plates are utilized to facilitate fastening and electrical contacting of the support post with the conductive bus leads. By way of example, the bottom portion of the vacuum switch and the contact **54*b* and the support post 52B associated therewith, is rigidly connected to support bus 59, with a plurality of bolts 58 extending through a support plate 61, the support bus 59, and are threaded into apertures provided in the lower planar mounting plate 56B. In like manner, a flexible bus conductor 60 is electrically connected to the upper end of the support post 52A via a plurality of bolts 58 which are threaded into apertures provided in the upper planar mounting plate 56A. The flexible bus conductor 60 permits axial movement of the support post 52A to permit opening and closing of the contact surfaces 54A and 54B** within the vacuum switch.

The operating mechanism 62 for opening and closing the vacuum switch contacts is designed to provide the required axial force needed to move the support post and to make contacts closing the switch, and to move them apart to open the switch. A rotatable shaft 64 is supported by spaced frame members 66A, 66B the shaft 64 has an eccentric cam member 68 thereon the eccentric cam member is mounted within suitable apertures provided in insulating connecting links 70. The connecting links 70 extend between the rotating shaft and the upper end of the flexible bus conductors. The cam member 68 is rotatable with shaft 64 to produce reciprocal movement of the connecting link member 70 along the axis of the vacuum switch. The connecting links 70 have arcuate bottom ends 72 which seat on an enlarged washer member 74 in a plurality of dished washer members 76 which act as overtravel springs. An auxiliary mounting plate member 78 is connected to the flexible bus conductor 60 with the flexible bus conductor 60 being sandwiched between the auxiliary mounting plate 78 and the upper planar mounting plate 56A via the bolts. An eye bolt 80 extends upwardly from the auxiliary mounting plate 78 with washers 74 and 76 about the shank of the eye bolt 80 with a connecting pin 82 extending through the linking member 70 and the aperture of the eye bolt 80. When the vacuum shorting switch is to be closed, the shaft 64 is rotated and the eccentric cam will cause the connecting link 70 to be axially displaced with the arcuate bottom ends acting on the washer 74 to transmit the axial force via the eye bolt, the auxiliary mounting plate 78, and the flexible lead or bus 60. The vacuum switch is opened by reversing the shaft rotation and axially moving the linking member 70 in the opposite direction.

The electrical shunting switch assembly of the present invention is preferably made portable by mounting on a wheeled trunk or dolly means, or is movable via overhead crane means. The bus conductor leads 18 and 20 of the FIG. 1 embodiment are connectable via bolt means not shown, to the electrolytic cell terminals. In this way the switch assembly can be moved from cell to cell in a type multi-cell system for periodic maintenance, and may be easily connected in place to shunt a particular cell.

The present invention provides an efficient and reliable electrical cell shunting vacuum switch assembly. The asynchronous or sequential operation of the vacuum switches effects a gradual diversion of current from the cell shunting switch assembly back through the cell and thereby greatly reduces the current and arc in the last-to-open vacuum switch. The last-to-open switch thus must only interrupt a current which is reliably interrupted without severe contact erosion or other switch thermal stressing.

The vacuum switches of the present invention are rated for continuous current of about 6000 amperes at up to ten volts DC with conventional copper or copper-bismuth contacts. These vacuum switches can reliably interrupt currents of up to about 25,000 amperes. The switch ratings can be increased by using refractory metal contacts.

I claim:

1. An electrical shunting switch assembly adapted to be electrically connected in parallel across an electrolytic cell, which assembly comprises;

(a) a plurality of electrically parallel branch conductor paths each of which includes a vacuum switch and a series resistance of predetermined value in each parallel switch containing branch, so that the current in each respective parallel branch is limited to a predetermined design value, and (b) means for asynchronously operating the vacuum switches to divert an increased portion of the current from the switch assembly back through the cell when the voltage across the switch assembly exceeds the cell electrolyzing potential, whereby the arc current which an individual vacuum switch must dissipate upon switch opening is limited to the predetermined design value.

2. The switch assembly set forth in claim 1, wherein the resistance value in each parallel branch is substantially equal.

3. The switch assembly set forth in claim 1, wherein the time between successive asynchronous operation of the switches is at least greater than about ten milliseconds.

4. The switch assembly set forth in claim 1, wherein the means for asynchronously operating the vacuum switches includes reciprocally movable linking means connected to each switch, an air cylinder for reciprocating the linking means, and an air cylinder controller for actuating the individual air cylinders at predetermined time intervals.

5. The switch assembly set forth in claim 1, wherein one or more of the parallel switch containing branches includes a sub-branch with a plurality of electrically parallel vacuum switches in the sub-branch.

6. The switch assembly set forth in claim 5, wherein the resistance value in each parallel branch which contains a plurality of electrically parallel vacuum switches in sub-branches is determined according to the number of parallel vacuum switches in sub-branches, so that the current carried by each parallel branch, when the switches are closed and the switch assembly is shunting the electrolytic cell, is approximately equal.

7. The switch assembly set forth in claim 1, wherein the plurality of electrically parallel vacuum switches are each independently operable and the assembly includes, a first branch path with a single vacuum switch and series resistance value, a second branch path with a series resistance value and a pair of electrically parallel vacuum switches in sub-branches, and at least one other branch path with a series resistance value and four electrically parallel vacuum switches in sub-branches.

8. The switch assembly set forth in claim 7, wherein the switch assembly includes one or more added electrically parallel branch paths which include four electrically parallel vacuum switches in sub-branches.

9. The switch assembly set forth in claim 7, wherein current is diverted from the switch assembly by opening the single vacuum switch in the first branch path, then closing the first branch path single vacuum switch and opening the pair of vacuum switches in the second branch path, then opening the first branch path single vacuum switch, then closing the first branch path single vacuum switch and the pair of second branch vacuum switches and opening the four vacuum switches in the at least one other branch path.

10. A method of diverting DC current from an electrical shunting switch assembly which is electrically connected in parallel shunting relationship to an electrolytic cell which exhibits a characteristic electrolyzing potential, which cell and switch assembly are electrically connected to the electrolytic cell DC power supply, which electrical shunting switch assembly comprises a plurality of electrically parallel branch conductor paths each of which includes at least one vacuum switch, and a series resistance of predetermined value in each parallel switch containing branch, which method comprises; asynchronously opening individual vacuum switches in a predetermined time sequence to increase the potential drop across the shunting switch assembly so that when the potential drop exceeds the cell electrolyzing potential a portion of the current will be diverted through the electrolytic cell, opening successive vacuum switches in a predetermined time sequence to divert an increased portion of the current through the electrolytic cell with a corresponding reduction in current through the shunting switch assembly, and opening the last to be opened vacuum switch to interrupt the reduced current which is at a predetermined design value.

* * * * *